US007264493B2

(12) United States Patent
Cooper et al.

(10) Patent No.: US 7,264,493 B2
(45) Date of Patent: Sep. 4, 2007

(54) HIGH FREQUENCY COAXIAL JACK

(75) Inventors: Steven R. Cooper, Round Lake Beach, IL (US); Zenon Sliczniak, Saint Charles, IL (US)

(73) Assignee: Switchcraft, Inc., Chicago, IL (US)

( * ) Notice: Subject to any disclaimer, the term of this patent is extended or adjusted under 35 U.S.C. 154(b) by 0 days.

(21) Appl. No.: 11/296,825

(22) Filed: Dec. 7, 2005

(65) Prior Publication Data

US 2007/0128930 A1 Jun. 7, 2007

(51) Int. Cl.
*H01R 29/00* (2006.01)

(52) U.S. Cl. ..... 439/188; 439/944

(58) Field of Classification Search ..... 439/188, 439/944, 620.03, 620.1, 620.3; 200/51.1
See application file for complete search history.

(56) References Cited

U.S. PATENT DOCUMENTS 5,598,132 A * 1/1997 Stabile ..... 333/22 R
5,730,612 A * 3/1998 Tatsuzuki ..... 439/188
6,045,378 A 4/2000 Follingstad
6,817,876 B2 11/2004 Cooper et al.

* cited by examiner

*Primary Examiner*—Javaid H. Nasri
(74) *Attorney, Agent, or Firm*—Schiff Hardin LLP

(57) ABSTRACT

A coaxial jack has an electrically groundable housing including first and second ports, a printed circuit board supporting a terminating element and conductive traces, and a center conductor disposed within the electrically groundable housing. The center conductor extends through a hole in the printed circuit board and is normally coupled to the electrically groundable housing contact through the terminating element and the conductive traces. A grounding spring has a leaf spring that acts as switch to break the coupling when a plug is inserted into the first port.

25 Claims, 3 Drawing Sheets

HIGH FREQUENCY COAXIAL JACK

TECHNICAL FIELD OF THE INVENTION

The present invention relates to coaxial jacks and, for example, to high frequency single coaxial jacks.

BACKGROUND OF THE INVENTION

Various types of coaxial jacks are well known. Such coaxial jacks generally include at least one center conductor disposed within a grounded electrically conductive housing to establish a signal path between first and second ports at opposing ends of the housing. The first port is arranged to receive a plug, and the second port is arranged to receive a connector. When no plug is inserted into the first port of the housing, the center conductor is typically terminated to ground through a terminating resistor. Thus, a connector in the second port is also terminated to ground. However, when a plug is inserted into the first port of the housing, the termination to ground is broken, allowing a signal to pass between a connector in the second port and the plug in the first port of the housing.

Prior coaxial jacks have a number of problems. These coaxial jacks typically rely on complicated switches to control the termination of the center conductor. Such switches add to the cost and labor required to produce coaxial jacks. Also, the switches typically used in prior art coaxial jacks are unreliable.

The jack of the present invention overcomes one or more of these or other problems.

SUMMARY OF THE INVENTION

In accordance with an aspect of the present invention, a coaxial jack comprises an electrically groundable housing including first and second ports, a printed circuit board supporting conductive traces, and a center conductor that is disposed within the electrically groundable housing so as to extend through a hole in the printed circuit board and so as to contact at least one of the conductive traces.

In accordance with another aspect of the present invention, a coaxial jack comprises an electrically groundable housing including first and second ports, a center conductor, and a grounding spring. The center conductor is disposed within the electrically groundable housing so as to extend through a hole in the printed circuit board and so as to contact at least one of the conductive traces. The grounding spring is within the first port and is arranged so that a plug received in the first port is received within the grounding spring. The grounding spring includes a contact to control signal flow between the first and second ports.

In accordance with still another aspect of the present invention, a coaxial jack comprises an electrically groundable housing including first and second ports, a printed circuit board supporting a terminating element and conductive traces, and a center conductor that is disposed within the electrically groundable housing so as to extend through a hole in the printed circuit board and so as to be normally coupled to the electrically groundable housing contact through the terminating element and the conductive traces.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
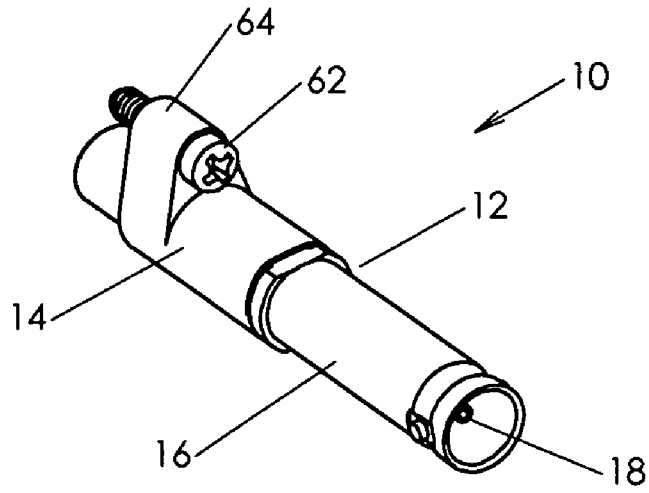
FIG. 1 is an isometric view of a jack according to one embodiment of the present invention.

A single self-terminating jack 10 according to one embodiment of the present invention is shown in FIGS. 1-7. The single self-terminating jack 10 includes a conductive housing 12 having a first port 14 at a first end of the conductive housing 12 and a second port 16 at a second end of the conductive housing 12. The first port 14 may be arranged to accept a plug such as a WECO plug, and the second port 16 may be arranged to accept a connector such as a BNC connector.

A center conductor 18 extending between the first and second ports 14 and 16 is provided within the conductive housing 12. The center conductor 18 is centered within the conductive housing 12 by an insulating member 20 and a printed circuit board 22.

Figure 2:
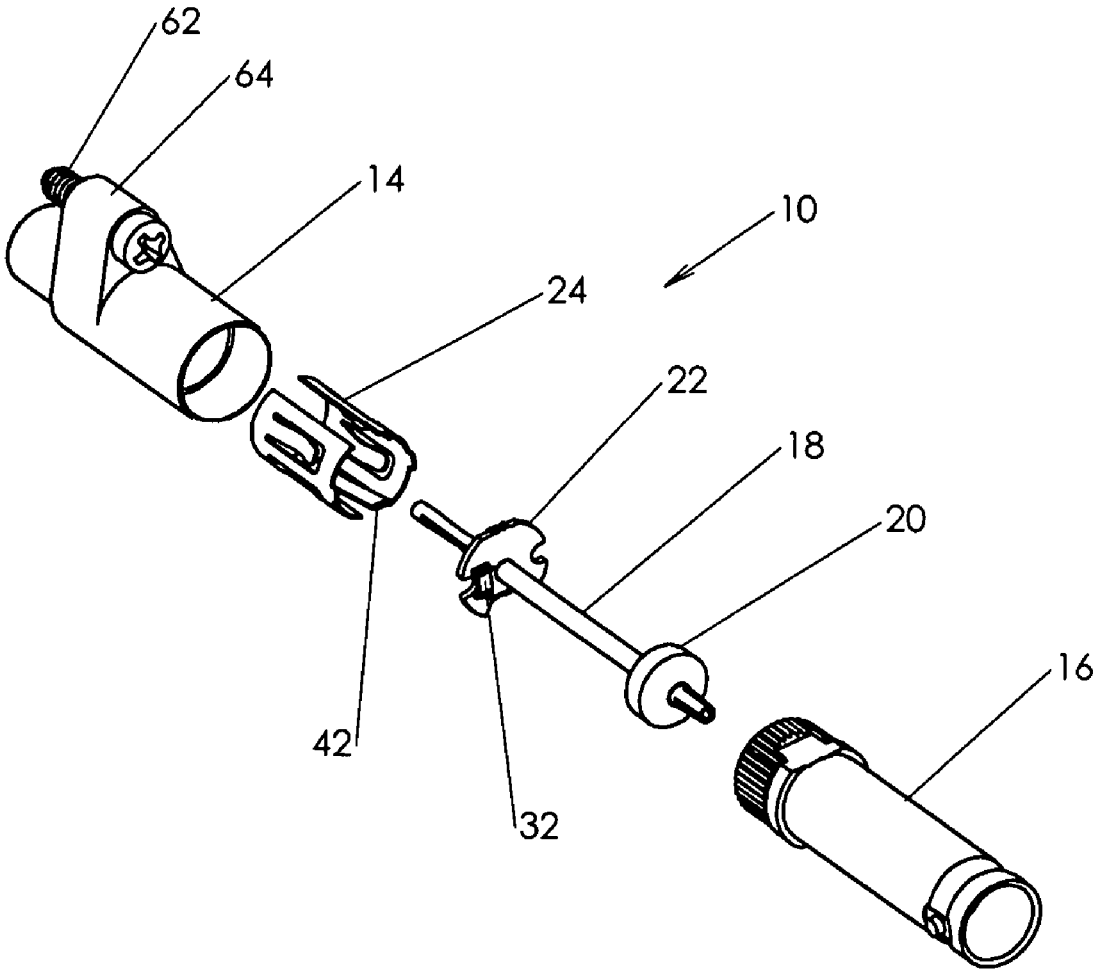
FIG. 2 is an exploded view of the jack of FIG. 1.
Figure 3:
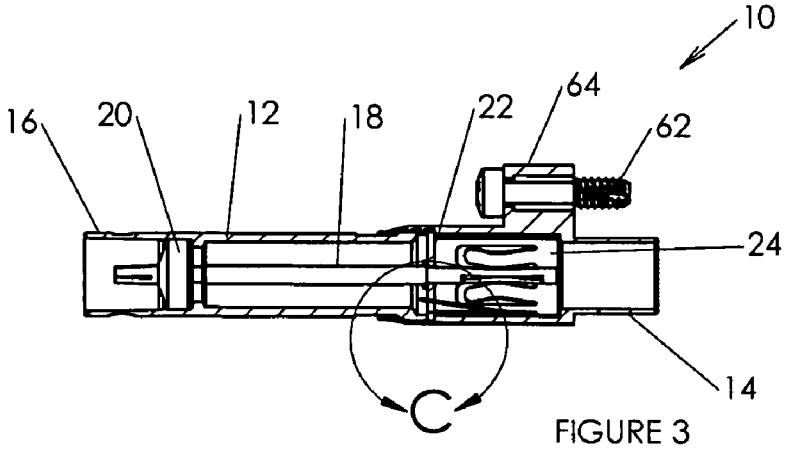
FIG. 3 is a cross sectional side view of the jack of FIG. 1.
Figure 5:
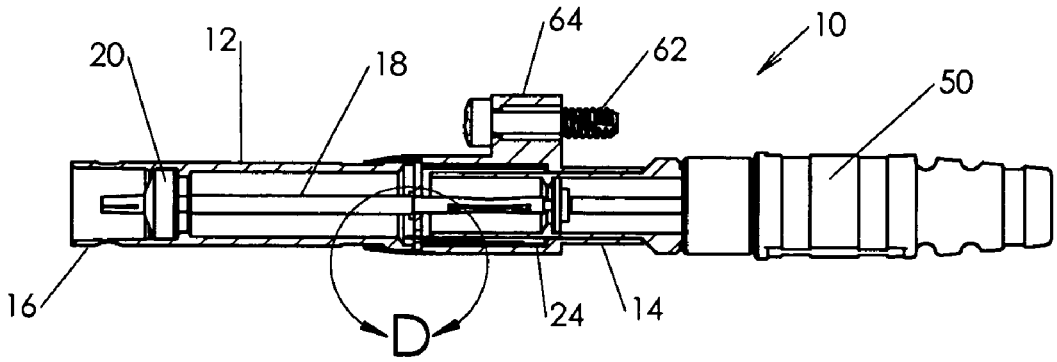
FIG. 5 is a cross sectional side view of the jack of FIG. 1 with a plug inserted into the jack.

As shown in FIGS. 3 and 5, the center conductor 18 extends through a center hole in the insulating member 20 to support one end of the center conductor 18 within the second port 16. The outer perimeter of the insulating member 20 substantially matches the inner perimeter of the second port 16 so that the insulating member 20 centers its corresponding end of the center conductor 18 within the second port 16. Although these perimeters may have any desired shapes, these perimeters may be relatively circular as shown in FIGS. 1 and 2 such that the insulating member 20 may be in the form of an insulating disc. The center conductor 18, when extending through the center hole of the insulating member 20, may, for example, be substantially perpendicular to the insulating member 20.

The conductive housing 12 also includes a conductive grounding spring 24 which has an outer perimeter that substantially matches the inner perimeter of the first port 14. As shown in FIGS. 3-6, the conductive grounding spring 24 butts up against the printed circuit board 22. The outer perimeter of the printed circuit board 22 substantially matches the inner perimeter of the first port 14, and the center conductor 18 extends through a center hole 26 of the printed circuit board 22. Consequently, the conductive grounding spring 24 electrically engages the first port 14 of the conductive housing 12, and the printed circuit board 22 centers its corresponding end of the center conductor 18 within the first port 14. Again, although these perimeters may have any desired shapes, these perimeters may be relatively circular as shown in FIGS. 1 and 2.

Figure 7:
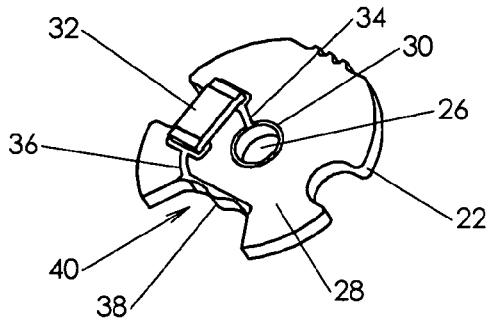
FIG. 7 is an isometric view of a printed circuit board used in the jack of FIGS. 1-6; and, FIG. 8 is an isometric view of a patchbay having a plurality of jacks, such as shown in FIGS. 1-6, inserted therein.

As shown in FIG. 7, the printed circuit board 22 includes an insulating board 28 having the center hole 26 extending there through to receive the center conductor 18. The center conductor 18, when extending through the center hole 26, may, for example, be substantially perpendicular to insulating board 28.

The circular wall of the insulating board 28 that forms the center hole 26 has a conductive trace 30 extending there around. A terminating element 32 is supported on the insulating board 28. The terminating element 32, for example, may be a resistor. The insulating board 28 also supports conductive traces 34 and 36. The terminating element 32, for example, may be a 75 Ω resistor.

The conductive trace 34 has a first end that electrically engages a first end of the terminating element 32 and a second end that electrically engages the conductive trace 30. The conductive trace 36 has a first end that electrically engages a second end of the terminating element 32 and a second end that electrically engages a conductive trace 38. The conductive trace 38 is provided along a perimeter wall of the insulating board 28 that is formed by a recess 40.

Figure 4:
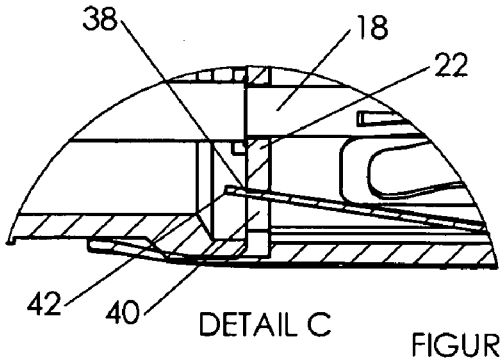
FIG. 4 illustrates a detail of the jack as shown in FIG. 3.
Figure 6:
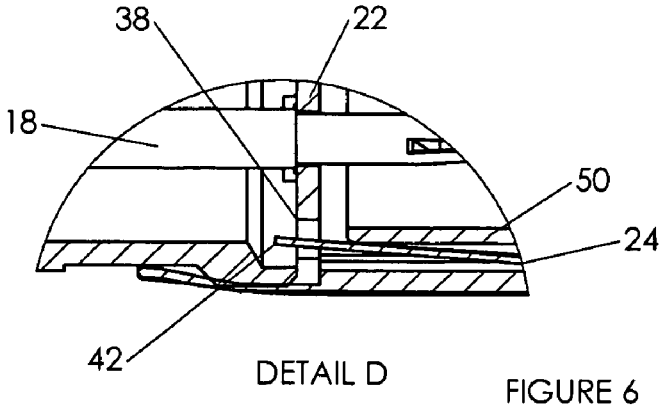
FIG. 6 illustrates a detail of the jack as shown in FIG. 5.

As perhaps best shown in FIGS. 2, 4, and 6, the conductive grounding spring 24 has a conductive leaf spring 42 that is of sufficient length to extend into the recess 40 of the printed circuit board 22. As explained hereinafter, the leaf spring 42 may be a contact and/or may perform the function of a switch.

With no plug inserted into the first port 14 of the single self-terminating jack 10 as shown in FIGS. 3 and 4, the conductive leaf spring 42 is pre-loaded to engage the conductive trace 38 on the printed circuit board 22. Accordingly, an electrical circuit is established from the conductive housing 12 through the conductive grounding spring 24, through the conductive leaf spring 42, through the conductive trace 38, through the conductive trace 36, through the terminating element 32, through the conductive trace 34, through the conductive trace 30, and to the center conductor 18. Thus, with the conductive housing 12 coupled to ground, the center conductor 18 is coupled to ground through the terminating element 32 when no plug is inserted into the first port 14, and any connector inserted into the second port 16 is also coupled to ground through the terminating element 32.

When a plug 50 is inserted into the first port 14 of the single self-terminating jack 10 as shown in FIGS. 5 and 6, the conductive leaf spring 42 is pushed away from the conductive trace 38 on the printed circuit board 22 by the plug 50. Accordingly, the electrical circuit from the conductive housing 12 through the conductive grounding spring 24, through the conductive leaf spring 42, through the conductive trace 38, through the conductive trace 36, through the terminating element 32, through the conductive trace 34, through the conductive trace 30, and to the center conductor 18 is broken. Thus, the center conductor 18 is no longer coupled to ground through the terminating element 32, and instead a signal from a connector inserted into the second port 16 is coupled through the center conductor 18 to the plug 50.

As can be seen from FIGS. 2, 5, and 6, the conductive grounding spring 24 is shaped so that the plug 50 is received within the conductive grounding spring 24 and so that the inside perimeter of the conductive grounding spring 24 substantially matches an outside perimeter of the plug 50. Accordingly, the outer conductive sheath of the plug 50 is coupled to ground by the first port 14.

Figure 8:
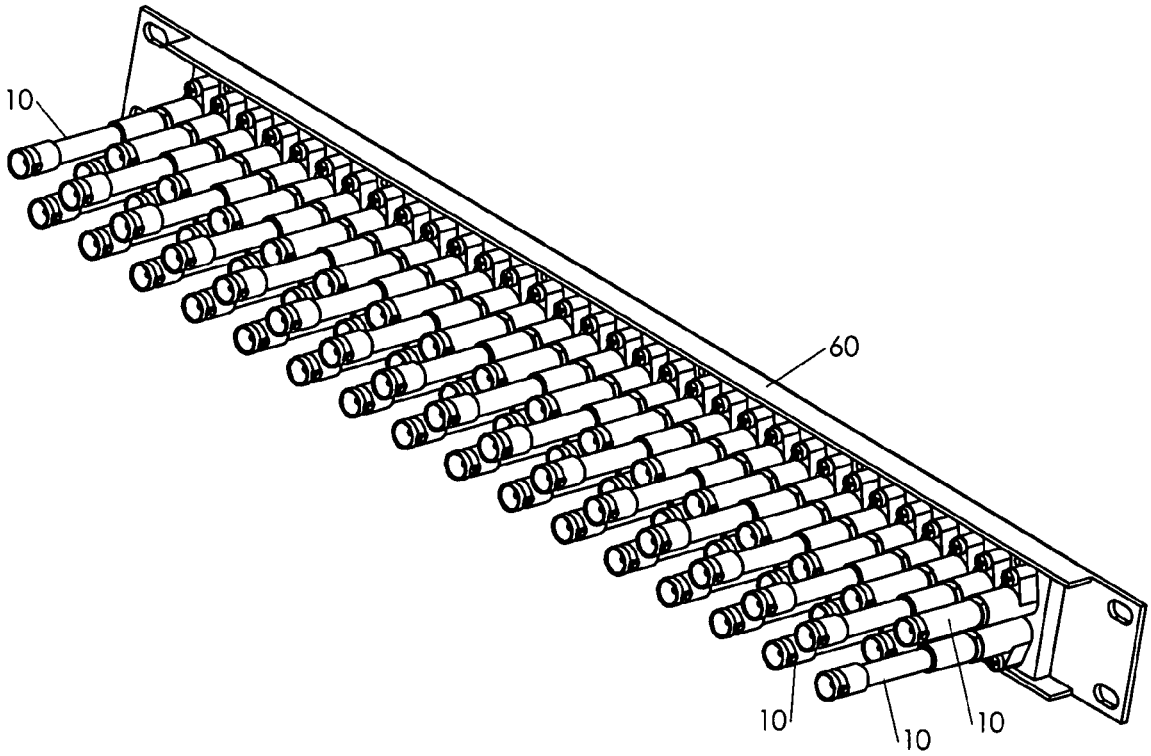

As shown in FIG. 8, a plurality of the single self-terminating jacks 10 are attached to a patchbay 60. Each of these single self-terminating jacks 10 is attached to the patchbay 60 by use of a fastener 62. The fastener 62, for example, may be a screw that is inserted through a flange post 64 of the conductive housing 12 and is threaded into a corresponding hole in the patchbay 60. As can be seen in FIG. 8, some of the single self-terminating jacks 10 are longer than others of the single self-terminating jacks 10. This difference in length between adjacent ones of the single self-terminating jacks 10 may be provided to accommodate the size of the BNC connectors of the cables that are to be coupled to the patchbay 60.

Examples of materials that may be used for the single self-terminating jack 10 are described below in this paragraph. However, it should be understood that other materials could be used without departing from the scope of the present invention. Accordingly, the conductive housing 12 including the first and second ports 14 and 16 may comprise a brass alloy plated with nickel. The fastener 62 may comprise a steel alloy plated with zinc. The conductive grounding clip 26 may comprise beryllium copper finished with gold or nickel plating. The insulating member 20 may comprise PTFE. The insulating board 28 may comprise PCB-FR-4 having conducting conductive traces made of copper finished with gold over nickel plating. The center connector 18 may be beryllium copper finished with gold over nickel plating.

Certain modifications of the present invention have been disclosed above. Other modifications will occur to those practicing in the art of the present invention. For example, the jack described above may come in a variety of sizes.

Moreover, the jack described above may be used as an audio, a video, and/or other jack.

Furthermore, as disclosed above, the terminating element 32 of the single self-terminating jack 10 is a resistor. Instead, one or more other passive and/or active devices may be used as the terminating element 32 in the single self-terminating jack 10.

Also, the present invention may be used in connection with jacks having more than two ports.

Additionally, the first and second ports 14 and 16 are shown in FIG. 2 as separate elements that make up the conductive housing 12. Instead, the first and second ports 14 and 16 may be integrally formed as the conductive housing 12 so that the conductive housing 12 is a single continuous member.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

We claim:

1. A coaxial jack comprising:

an electrically groundable housing including first and second ports;

a printed circuit board supporting conductive traces; and, a center conductor disposed within the electrically groundable housing so as to extend through a hole in the printed circuit board and so as to contact at least one of the conductive traces and to remain in contact with the at least one of the conductive traces even when a coaxial plug is received within the first port.

2. The coaxial jack of claim 1 further comprising a switch within the electrically groundable housing, wherein the switch is arranged to interact with the conductive traces so as to control a flow of a signal through the center conductor and between the first and second ports.

3. The coaxial jack of claim 2 wherein the switch comprises a conductive leaf spring that is arranged to be moved by a plug inserted into the first port so as to control the signal flow.

4. The coaxial jack of claim 1 wherein the electrically groundable housing further includes an insulating member, wherein the insulating member has a hole, and wherein the center conductor is disposed within the electrically groundable housing so as to extend through the hole in the insulating member.

5. The coaxial jack of claim 4 further comprising a switch within the electrically groundable housing, wherein the switch is arranged to interact with the conductive traces so as to control a flow of a signal through the center conductor and between the first and second ports.

6. The coaxial jack of claim 5 wherein the switch comprises a conductive leaf spring that is arranged to be moved by a plug inserted into the first port so as to control the signal flow.

7. The coaxial jack of claim 4 wherein the holes in the printed circuit board and in the insulating member are arranged so that the center conductor is substantially centered within the electrically groundable housing.

8. The coaxial jack of claim 1 wherein the hole in the printed circuit is arranged so that the center conductor is substantially centered within the electrically groundable housing.

9. A coaxial jack comprising:

an electrically groundable housing including first and second ports;

a center conductor disposed within the electrically groundable housing, wherein the center conductor extends between the first and second ports; and, a grounding spring within the first port and arranged so that a plug received in the first port is received within the grounding spring, wherein the grounding spring includes a contact to control signal flow between the first and second ports, and wherein the contact electrically connects the center conductor with the grounding spring when no plug is received by the first port and electrically disconnects the center conductor with the grounding spring when a plug is received by the first port.

10. The coaxial jack of claim 9 wherein the grounding spring has an outside perimeter substantially matching an inside perimeter of the electrically groundable housing, and wherein the plug is received within the grounding spring.

11. The coaxial jack of claim 9 further comprising a printed circuit board supporting conductive traces, wherein the center conductor is disposed within the electrically groundable housing so as to extend through a hole in the printed circuit board and so as to contact at least one of the conductive traces.

12. The coaxial jack of claim 11 wherein the contact is arranged to interact with the conductive traces so as to control the signal flow between the first and second ports.

13. The coaxial jack of claim 9 wherein the electrically groundable housing further includes an insulating member, wherein the insulating member has a hole, and wherein the center conductor is disposed within the electrically groundable housing so as to extend through the hole in the insulating member.

14. The coaxial jack of claim 13 further comprising a printed circuit board supporting conductive traces, wherein the center conductor is disposed within the electrically groundable housing so as to extend through a hole in the printed circuit board and so as to contact at least one of the conductive traces.

15. The coaxial jack of claim 14 wherein the contact is arranged to interact with the conductive traces so as to control the signal flow between the first and second ports.

16. The coaxial jack of claim 14 wherein the holes in the printed circuit board and in the insulating member are arranged so that the center conductor is substantially centered within the electrically groundable housing.

17. A coaxial jack comprising:

an electrically groundable housing;

a printed circuit board supporting a terminating element and conductive traces;

a center conductor disposed within the electrically groundable housing so as to extend through a hole in the printed circuit board and so as to be normally coupled to the electrically groundable housing contact through the terminating element and the conductive traces, wherein the center conductor forms first and second female coaxial ports with the electrically groundable housing; and, a switch within the electrically groundable housing, wherein the switch is arranged to be responsive to a plug inserted into the first female port so as to decouple the center conductor from the electrically groundable housing, and wherein the switch comprises a conductive leaf spring that is arranged to be moved by the plug when the plug is inserted into the first female port.

18. The coaxial jack of claim 17 further comprising a grounding spring within the first female port, wherein the grounding spring is arranged so that the plug is received within the grounding spring, and wherein the leaf spring is an element of the grounding spring.

19. The coaxial jack of claim 18 wherein the grounding spring has an outside perimeter substantially matching an inside perimeter of the electrically groundable housing.

20. The coaxial jack of claim 19 wherein the electrically groundable housing further includes an insulating member, wherein the insulating member has a hole, and wherein the center conductor is disposed within the electrically groundable housing so as to extend through the hole in the insulating member.

21. The coaxial jack of claim 20 wherein the holes in the printed circuit board and in the insulating member are arranged so that the center conductor is substantially centered within the electrically groundable housing.

22. A coaxial jack comprising:

an electrically groundable housing including first and second ports;

a center conductor disposed within the electrically groundable housing, wherein the center conductor extends between the first and second ports; and, a grounding spring within the first port and arranged so that a plug received in the first port is received within the grounding spring, wherein the grounding spring includes a contact to control signal flow between the first and second ports, wherein the grounding spring has an exterior that physically engages the electrically groundable housing, and wherein the grounding spring has an interior that receives and electrically engages the plug received in the first port.

23. A coaxial jack comprising:

an electrically groundable housing having first and second ports;

a printed circuit board supporting a terminating element and conductive traces;

a center conductor disposed within the electrically groundable housing so as to extend through a hole in the printed circuit board and so as to be normally coupled to the electrically groundable housing contact through the terminating element and the conductive traces; and, a switch within the electrically groundable housing, wherein the switch is arranged to be responsive to a plug inserted into the first port so as to de-couple the center conductor from the electrically groundable housing, and wherein the switch comprises a conductive leaf spring that is arranged to be moved by the plug when the plug is inserted into the first port.

24. The coaxial jack of claim 23 further comprising a grounding spring within the first port, wherein the grounding spring is arranged so that the plug is received within the grounding spring, and wherein the leaf spring is an element of the grounding spring.

25. The coaxial jack of claim 24 wherein the grounding spring has an inside perimeter substantially matching an outside perimeter of the plug received within the grounding spring, and wherein the grounding spring has an outside perimeter substantially matching an inside perimeter of the electrically groundable housing.

* * * * *